United States Patent [19]

Breedlove

[11] 4,237,527

[45] Dec. 2, 1980

[54] FLASHLIGHT APPARATUS

[76] Inventor: Leon J. Breedlove, 453 Nassau Dr., Baton Rouge, La. 70815

[21] Appl. No.: 951,584

[22] Filed: Oct. 16, 1978

[51] Int. Cl.[2] ..... F21L 7/00

[52] U.S. Cl. ..... 362/189; 362/202

[58] Field of Search ..... 362/189, 202

[56] References Cited

U.S. PATENT DOCUMENTS 4,041,304 8/1977 Spector ..... 362/202

*Primary Examiner*—Stephen J. Lechert, Jr.

*Attorney, Agent, or Firm*—Robert D. Farkas

[57] ABSTRACT

This disclosure pertains to a flashlight housing having a corrugated flexible end adjacent the lamp and reflector opening. A cap at the other end, when removed permits the inclusion of the battery within the housing. The center pole of the lamp and one end of a conducting strip is urged into contact with the opposed terminals of the battery by the bias forces exerted by the corrugations in the case upon the lamp and reflector associated therewith. The other end of the conducting strip may be forced into electrical contact with the other pole of the lamp, by way of the non-reflecting side of the reflector when a portion of the corrugations are manually depressed inwardly, thereby energizing the lamp.

7 Claims, 4 Drawing Figures

FLASHLIGHT APPARATUS

BACKGROUND OF THE INVENTION

1. The Field of the Invention

This invention relates to flashlights and more particularly to that class devoid of metallic springs utilized to urge the terminals of the battery into electrical contact with conducting apparatus.

2. Description of the Prior Art

The prior art abounds with flashlights of various configurations and serving various purposes. U.S. Pat. No. 2,234,972 issued on Mar. 18, 1941 to W. M. Lennan teaches a waterproof flashlight, having the switch operating mechanism encased within a rubber-like housing and utilizing a metallic spring to urge the battery into electrical contact with conducting elements comprising the internal electrical circuitry of the battery.

U.S. Pat. No. 2,231,382 issued on Feb. 11, 1941 to A. J. Desimone discloses a flashlight housing containing a spring and a spare lamp element disposed there-within. The spring is utilized in conventional fashion whilst the housing is manufactured from a transluscent material adapted to provide an attractive and unusual appearance when the bulb is lit.

The aforementioned Patents suffer the common deficiency of providing a relatively expensive construction which, by virtue of the use of the spring portion therein, will eventually deteriorate due to rust.

SUMMARY OF THE INVENTION

A primary object of the present invention is to provide an inexpensive flashlight apparatus whose housing portion insures that the requisite electrical connections are satisfactorily completed without requiring the use of a spring.

Another object of the present invention is to provide a flashlight without an external switch mechanism thereby lowering the cost of manufacture and insuring the water-proofness thereof.

Still another object of the present invention is to provide a flashlight apparatus utilizing a minimum number of components, particularly those of metallic variety thereby enhancing the life of the article of manufacture.

Yet another object of the present invention is to provide a flashlight housing that can, if desired, be fabricated from two non-metallic parts thereby minimizing the possibility of moisture transmitting therethrough to the internal working elements thereof.

Undeveloped areas, such as the tropics, require flashlights which possess special characteristics and whose cost must be maintained low in order to be affordable and to be placed in wide use. The special characteristics include the ability of the light to be sensibly waterproof and to utilize a minimum number of metallic parts. Metals are easily corroded and are subject to exceptional mechanical stresses due to the climate and hard use experienced in remote areas. An inexpensive plastic molding is utilized to house a battery and switch element further reducing costs and limiting the ability of the internal components to be attacked by moisture. A weakened area in the wall of the housing may be depressed by the thumb of the user, operating the switch contained within the housing when the housing is being grapsed manually in a use position.

DESCRIPTION OF THE PREFERRED EMBODIMENT

Figure 2:
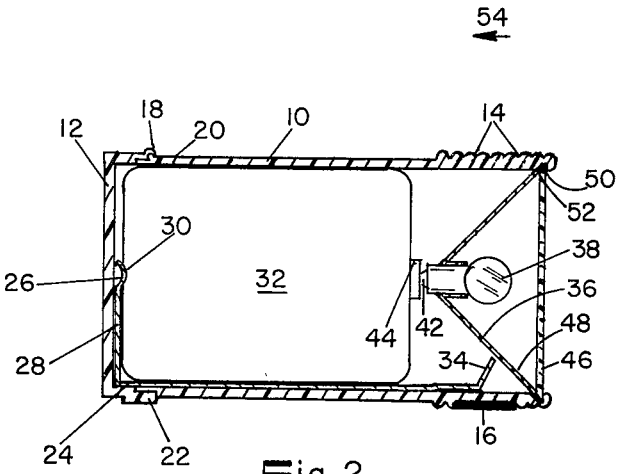
FIG. 2 is a cross sectional view of the apparatus shown in FIG. 1.

The structure and method of fabrication of the present invention is applicable to a plastic flashlight housing comprising a hollow right angle cylinder having an open mouth at one end thereof. A plastic cap, adapted with a resilient circular wall portion is permitted to snap over the open mouth portion of the housing, providing a waterproof seal therewith and requiring substantial manipulative forces to release the cap from the housing.

A portion of the length, adjacent the other end of the housing is adapted with annular corrugations. Since the housing material is manufactured from a pre-tensioned plastic composition, the other free end of the housing is urged towards the end of the housing to which the cap is affixed. In one embodiment of the present invention, the other end of the housing has a clear transparent element thereof stretching across the opening thereat. This transparent element forms an integral part of the housing. An alternate embodiment includes a plastic circular plate, being transparent, whose marginal edges reside in an annular groove in the interior walls of the housing disposed adjacent the open end portion at the other end of the housing.

A truncated conical surface, fabricated from a plastic material, and having metallicized interior and exterior surfaces, is adapted to have the wide marginal edges thereof reside adjacent the interior marginal edges of the transparent plastic "lens" element of the flashlight. A lamp is disposed within the apex of the reflector having its ferrule-like base element electrically contacting and secured to the apex of the reflector, and having the light producing portions thereof centrally disposed within the interior conical surfaces of the reflector.

During the assembly process, the cap is removed and a U-shaped metallic strap is partially wrapped about the length of a battery, such that one leg of the U-shaped strap contacts the negative circular pole, at one end of the battery, comprising the negative terminal thereof. The other leg of the U-shaped conducting strap is disposed adjacent to but not contacting the centrally disposed positive contact of the battery at the other end thereof. The battery and the U-shaped contacting strap are inserted into the mouth opening of the flashlight housing so as to have the negative terminal of the battery adjacent the open mouth portion of the housing. Since the corrugations are totally contracted, a portion of the battery adjacent the negative pole and the adjacent portion of the U-shaped strap extends slightly outwardly from the mouth portion of the housing. When the cap is snapped onto the housing, the battery and U-shaped strap are urged totally within the housing so as to cause the positive terminal of the battery to contact the center terminal of the lamp. The corrugations are extended in length and exert a bias force against the positive pole of the battery through the reflector and lamp, and causes the negative pole of the battery to forcibly contact the adjacent leg of the U-shaped strap, not sandwiched against the inner face of the strap. Thus, the spring type bias forces exerted by the corrugations of the housing, effectively maintain electrical contact between the center pole of the lamp and one end of the strap to opposed poles of the battery whilst effectively locking the battery within the housing.

A depression, formed within an area of the corrugations, and suitably colored, when depressed by the thumb of the user, causes the free unengaged leg of the strap to electrically contact the reflector, thereby electrically completing the series circuit including the battery, the lamp, a conducting portion of the reflector and the U-shaped strap. Maintaining an inwardly directed force upon the area of depression continues the energization of the lamp.

Figure 1:
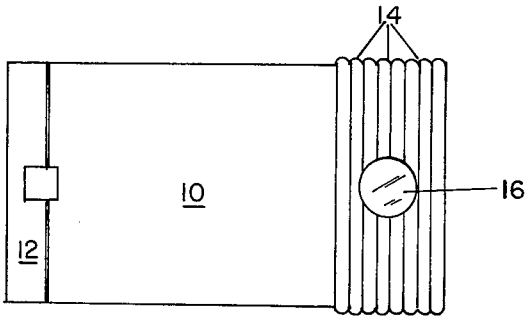
FIG. 1 is a side view of the present invention.

Now referring to the Figures, and more particularly to the embodiment illustrated in FIG. 1 showing a housing 10 having a cap 12 disposed at one end thereof. A plurality of annular corrugations 14 reside at one end of the housing. A circular depression 16 is located occupying a discrete area of the corrugations 14.

Figure 4:
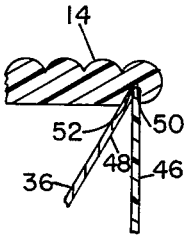
FIG. 4 is an enlarged view of a portion of the apparatus shown in FIG. 2.

FIG. 2 and FIG. 4 illustrates the housing 10 upon which cap 12 resides utilizing lip 18 thereof the engage the end 20 of the housing adapted within an open mouth. Wing 22 is utilized to pry off lip 18 from end 20 of the housing. Generally U-shaped conducting strap 24 is shown disposed within housing 10 and having the end 26 of leg 28 contacting the negative terminal 30 of battery 32 confined within the housing. End 34 of U-shaped strap 24 is shown disposed not contacting conducting reflector 36. Lamp 38 has its ferrule terminal 40 clamped within and electrically contacting reflector 36. Lamp center terminal 42 is shown electrically contacting the positive central terminal 44 of battery 32. Lens 46, possessing transparent characteristics resides adjacent the widest portion 48 of reflector 36.

Circular lens 46 is shown retained within annular groove 50 whilst the widest portion 48 of reflector 36 is shown retained within groove 52. Corrugations 14 exert a force in the direction of arrow 54 on portion 48 of reflector 36, and thence through lamp 38 against positive pole 44, urging the negative pole 30 of battery 32 to electrically contact end 26 of leg 28, whilst compressing leg 28 against cap 12. Depression 16 is disposed adjacent leg 34.

Figure 3:
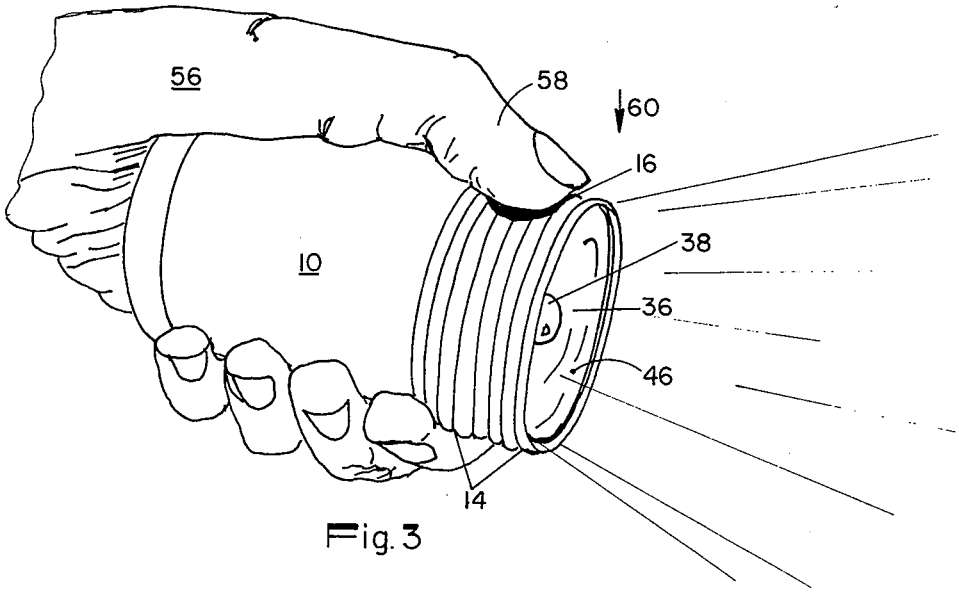
FIG. 3 is a perspective view of the apparatus shown in FIG. 1.

FIG. 3 illustrates hand 56 grasping housing 10 and utilizing thumb 58 thereof to apply a force in the direction of arrow 60 against depression 16. End 34, shown in FIG. 2 is disposed radially inwardly thereby so as to electrically contact reflector 36. Lamp 38 is energized causing light rays, not shown, to pass through transparent lens 46, focused and intensified by reflector 36.

One of the advantages of the present invention is an inexpensive flashlight apparatus whose housing portion insures that the requisite electrical connections are satisfactorily completed without requiring the use of a spring.

Another advantage of the present invention is a flashlight without an external switch mechanism thereby lowering the cost of manufacture and insuring the water-proofness thereof.

Still another advantage of the present invention is a flashlight apparatus utilizing a minimum number of components, paticularly those of metallic variety thereby enhancing the life of the article of manufacture.

Yet another advantage of the present invention is a flashlight housing that can, if desired, be fabricated from two non-metallic parts thereby minimizing the possibility of moisture transmitting therethrough to the internal working elements thereof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A flashlight apparatus comprising a housing, a cap, said cap removably affixed to one end of said housing, a mouth portion of said housing, said cap being disposed covering said mouth portion, a transparent sheet, said transparent sheet being fixedly secured to the other end of said housing, a light reflecting element, an incandescent lamp, one pole of said incandescent lamp engaging said light reflecting element, said incandescent lamp and said light reflecting element being disposed within said housing adjacent said transparent sheet, a contacting strap, a battery, said contacting strap and said battery being disposed passing through said mouth portion and residing entirely within said housing, a plurality of annular corrugations disposed in the exterior surface of said housing adjacent said other end thereof, said plurality of corrugations for urging said transparent sheet towards said one end of said housing, one end of said contacting strap being disposed electrically contacting one pole of said battery, the other pole of said incandescent lamp being disposed contacting the other pole of said battery, means to electrically connect the other end of said contacting strap to said one pole of said incandescent lamp said electrically connecting means including a circular depression located within said plurality of corrugations, said depression disposed adjacent to said other end of said contacting strap, said other end of said contacting strap being disposed radially inwardly of said housing upon the applicaion of manually radially inwardly directed forces upon said depression, said other end of said contacting strap forming a part of a series circuit including the poles of said battery and the poles of said incandescent lamp and said one end of said contacting strap, wherein said cap and said housing and said transparent sheet comprise a waterproof enclosure, said series circuit entirely residing within said enclosure.

2. The flashlight as claimed in claim 1 wherein said series circuit further comprises portions of said light reflecting element, said portions of said light reflecting element having electrical conducting properties.

3. The flashlight as claimed in claim 2 wherein said light reflecting element comprises a hollow truncated right angle cone, the base of said cone being disposed adjacent said transparent sheet, the apex of said cone clampingly engaging said one pole of said incandescent lamp.

4. The flashlight as claimed in claim 3 wherein said light reflecting element comprises a plastic material, the surfaces of said light reflecting element comprising an electrically conducting material.

5. The flashlight as claimed in claim 1 wherein said transparent sheet forms an integral part of said housing, said housing being fabricated from a plastic material.

6. The flashlight as claimed in claim 1 wherein said transparent sheet comprises a circular disc, the marginal edges of said circular disc being fixedly secured to said other end of said housing.

7. the flashlight as claimed in claim 1 wherein said cap comprises a plastic material, said cap having a mouth portion and wall portions adjacent thereto, said wall portions being disposed clamping said one end of said housing and forming a water-proof joint therewith.

* * * * *